United States Patent [19]

Sanuki et al.

[11] 4,150,973

[45] Apr. 24, 1979

[54] METHOD OF CONTROLLING MOLTEN STEEL TEMPERATURE AND CARBON CONTENT IN OXYGEN CONVERTER

[75] Inventors: Shin-ichi Sanuki, Kishiwada; Yuziro Ueda, Sakai; Toru Yoshida, Sakai; Tomoaki Kume, Sakai; Kosaburo Ikenouchi, Kitakyushu, all of Japan

[73] Assignee: Nippon Steel Corporation, Tokyo, Japan

[21] Appl. No.: 767,762

[22] Filed: Feb. 11, 1977

[30] Foreign Application Priority Data

Feb. 24, 1976 [JP] Japan ..... 51-18445
Feb. 24, 1976 [JP] Japan ..... 51-18446

[51] Int. Cl.[2] ..... C21C 5/30
[52] U.S. Cl. ..... 75/60
[58] Field of Search ..... 75/60

[56] References Cited

U.S. PATENT DOCUMENTS

| | | | |
|---|---|---|---|
| 3,566,671 | 3/1971 | Blum | 75/60 |
| 3,574,598 | 4/1971 | Kern | 75/60 |
| 3,871,871 | 3/1975 | Denis | 75/60 |

*Primary Examiner*—P. D. Rosenberg

[57] ABSTRACT

A method of controlling the temperature of molten steel and the carbon content in an oxygen converter comprising the steps of, making measurements by the use of a detecting probe at the suitable time in the midst of the blowing; measuring the actual value at that time as the starting point for the thereafter operation of prediction; using the amount of slag accumulated oxygen as a principal parameter for operation of the prediction, and combining the third feature stated above with the second feature stated above for obtaining the predicted value with higher accuracy.

8 Claims, 11 Drawing Figures

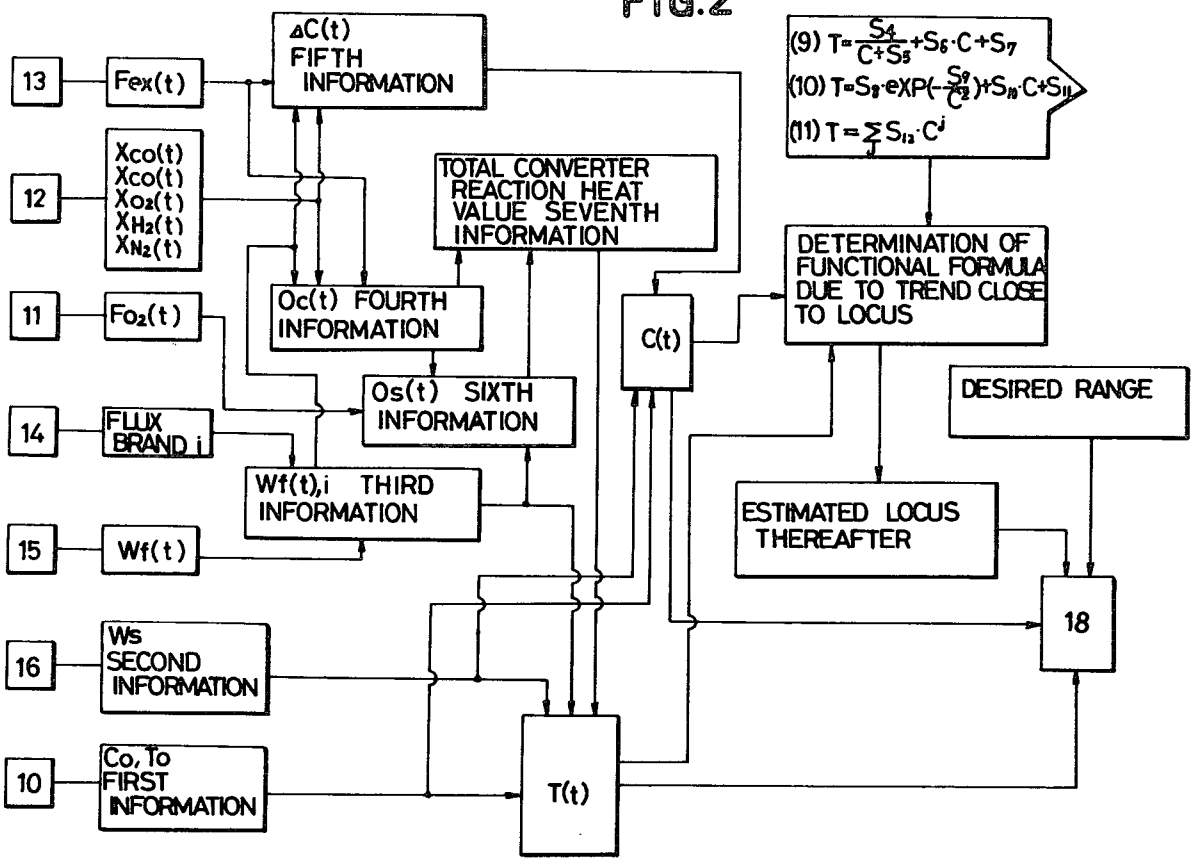
FIG. 2
(9) $T=\frac{S_4}{C^2+S_5}+S_6\cdot C+S_7$
(10) $T=S_8\cdot\exp(-\frac{S_9}{C^2})+S_{10}\cdot C+S_{11}$
(11) $T=\sum_j S_{12}\cdot C^j$
DETERMINATION OF FUNCTIONAL FORMULA DUE TO TREND CLOSE TO LOCUS
DESIRED RANGE
18
ESTIMATED LOCUS THEREAFTER
C(t)
TOTAL CONVERTER REACTION HEAT VALUE SEVENTH INFORMATION
T(t)
ΔC(t) FIFTH INFORMATION
Oc(t) FOURTH INFORMATION
Os(t) SIXTH INFORMATION
Wf(t),i THIRD INFORMATION
Fex(t)
Xco(t) Xco(t) Xo2(t) XH2(t) XN2(t)
Fo2(t)
FLUX BRAND i
Wf(t)
Ws SECOND INFORMATION
Co, To FIRST INFORMATION
13
12
11
14
15
16
10

METHOD OF CONTROLLING MOLTEN STEEL TEMPERATURE AND CARBON CONTENT IN OXYGEN CONVERTER

BACKGROUND OF THE INVENTION

The present invention relates to a method of controlling the temperature of molten steel and the carbon content in an oxygen converter.

As is known, in the blowing operation in the oxygen converter, it is customary to stop the blowing process whenever the molten steel has attained the desired temperature and carbon content. Actually, however, it is difficult to accurately attain the desired temperature and carbon content. For this reason, feeding of oxygen is stopped immediately before the predicted blow-stopping time when the desired levels are attained, and the converter may be tilted to measure the temperature and to take a sample analysis. This method, however, is inefficient and therefore impractical. Comparatively lately, there is proposed a method in which using a sub-lance, a detection probe is immersed into the molten steel immediately before the predicted blow-stopping time to simultaneously measure the temperature of the molten steel and the carbon content, and from the measured values thereof the variation in temperature and the variation in carbon content may be predicted using a static model and to thereby control the feeding of oxygen and to throw or charge the auxiliary raw material or flux in order to attain the desired values. In the static model as noted above, however, the decarburization rate and variation in temperature rise of the molten steel are all analyzed primarily in connection with the amount of blowing oxygen, and consequently, in the actual blowing operation, the rate to hit the desired values is excessively low and in addition, irregularities often occur.

SUMMARY OF THE INVENTION

It is an object of the present invention to provide a method for controlling the molten steel temperature and the carbon content in an oxygen converter with high accuracy to properly predict and control variation thereof.

It is another object of the present invention to provide a method of controlling the temperature of molten steel and the carbon content, which is capable of enhancing the rate to hit the desired values of the temperature of molten steel and the carbon content in the actual blowing operation and reducing the irregularities.

The present inventors have found that highly precise temperature of molten steel and carbon content thereof may be predicted by taking the amount of slag accumulated oxygen due to oxidation and the amount of decarburization obtained from the exhaust gases into consideration.

In conventional methods, an error often occurs in the prediction of the molten steel temperature and the carbon content to be a precondition of control, which results in the cause of lowering the rate of hit or target hitting rate. Principal reasons for occurrence of errors are as follows: That is, it is because of the fact that although oxygen used for the blowing is consumed in the furnace to decarburize and to form slags representative of the formation of iron oxides, distribution of the oxygen to the decarburization and the formation of iron oxides is not the value determined through the blowing but varies during the course of the blowing and every blowing, and in spite of this, such distribution is supposed constant or in terms of a given relative formula. Thus, in the conventional method, it has failed to accurately grasp the situation in which the oxygen is consumed for the decarburization and the rate of the formation of the iron oxides, which results in a relatively great error in the actual operation.

The present inventors have first found these problems noted above with respect to the prior art methods, and have used them as the starting point for a number of repeated studies made later. The present invention has been achieved as a result of such studies for a long period of time.

In one embodiment of the present invention, the temperature of molten steel and the carbon content obtained by simultaneous detection thereof in an oxygen converter at a suitable time during the course of the blowing process without stopping the feed of oxygen using for example a sub-lance may be used as a first information. We want to call your attention to the point of the detection at the suitable time during the course of the blowing process and to the point of the detection without stopping the feed of oxygen.

Further, the composition of the charge within the converter and the amount charged obtained prior to said detected time may be used as a second information, said composition of the charge being analyzed prior to the detected time and the amount charged being weighed prior to the charging time. The brand of flux or coolant charged at need after said detected time and the amount charged may be used as a third information, the composition of the flux or coolant being previously analyzed and known, and the amount charged being detected by measuring the rate of feed at the time the flux or coolant is charged. Moreover, the amount of oxygen used for decarburization and the amount of decarburization obtained on the basis of the amount of exhaust gases and the composition of the exhaust gases continuously measured after said detected time and said third information may be used as a fourth information and a fifth information, respectively, the amount of slag accumulated oxygen obtained on the basis of the amount of oxygen to be fed continuously measured after said detected time, said third information and said fourth information is used as a sixth information, and the total converter reaction heat value obtained from said fourth information and sixth information used as a seventh information. Here, we want to call your attention to the point that the amount of slag accumulated oxygen is used as a principal parameter (the sixth information) for operation of prediction.

After various information have been obtained in the procedure as described above, continuous variation in the temperature of molten steel from the second information, the third information, and the seventh information with the first information as the starting point may be obtained, and the continuous variation in the carbon content in the molten steel may be obtained from the second information and the fifth information. Thus, the actually measured value at the suitable time during the blowing is used as the starting point for thereafter operation of prediction, and the amount of slag accumulated oxygen may be utilized as a principal parameter for operation of prediction to enable continuous prediction after the starting point.

Further, after various information have been obtained in the procedure as described above, continuous estimated locus in the temperature of molten steel from the second information, the third information, and the seventh information with the first information as the starting point may be obtained, and the continuous estimated locus in the carbon content in the molten steel may be obtained from the second information and the fifth information. Then, a regression equation is obtained using a plurality of relative equations between the molten steel temperature and the carbon content precalculated, with respect to an established retroactive locus curve with the suitable time in the middle or final stage of blowing being a reference, to predict locus variation after said time, and the blowing is controlled in accordance with a difference between the results of said prediction and the desired molten steel temperature and the desired carbon content in the molten steel. Thus, the actually measured value at the suitable time during the blowing is used as the starting point for thereafter operation of prediction, and the amount of slag accumulated oxygen may be utilized as a principal parameter for operation of prediction to enable continuous prediction and control after the starting point.

In this way, highly precise predicted values may be obtained accurately, resulting in the success in developing a control method which gives a positive index of the thereafter operation and which is extremely high in the target hitting rate. The highly precise prediction is an indispensable condition for obtaining the molten steel having the desired temperature of molten steel and the desired carbon content. If the predicted value should be out of order, the desired molten steel could not be obtained however much one may pay attention to the thereafter operation and the control.

The essential features of one aspect of the present invention may be summarized as follows: (1) The measurement by the use of a detecting probe can be made at the suitable time in the midst of the blowing; (2) The actually measured value measured at that time can be used as the starting point for the thereafter operation of prediction; (3) The continuous estimation after the starting point is made possible using the amount of slag accumulated oxygen as a principal parameter for operation of prediction; and (4) The feature noted in (3) may be combined with the feature, in which the actually measured value is used as the starting point, to obtain the estimated value with higher accuracy.

Further, the essential features of another aspect of the present invention may be summarized as follows: (1) The measurement by the use of a detecting probe can be made at the suitable time in the midst of the blowing; (2) The actually measured value measured at that time can be used as the starting point for the thereafter operation of prediction; (3) The continuous prediction after the starting point is made possible using the amount of slag accumulated oxygen as a principal parameter for operation of prediction; (4) The feature noted in (3) may be combined with the feature, in which the actually measured value is used as the starting point, to obtain the estimated value with higher accuracy; (5) The aforesaid continuous variation is detected as a locus, the established retroactive locus line (linear or curve), that is, the trend of continuous variation close to the aforesaid estimated value, is grasped at the suitable time in the middle or final stage (preferably, the time good for control effect) of the blowing to find what locus is depicted by points in continuous variation, and the locus of the thereafter successive continuous variation is predicted and calculated on the basis of the trend of locus; and (6) The estimated locus and the difference between the desired molten steel temperature and carbon content are detected, and the thereafter blowing is controlled with high accuracy so as to eliminate such difference.

BRIEF DESCRIPTION OF THE DRAWINGS

FIG. 2 is a flow chart schematically illustrating one embodiment of the method in accordance with the present invention.

DESCRIPTION OF PREFERRED EMBODIMENTS

Figure 1:
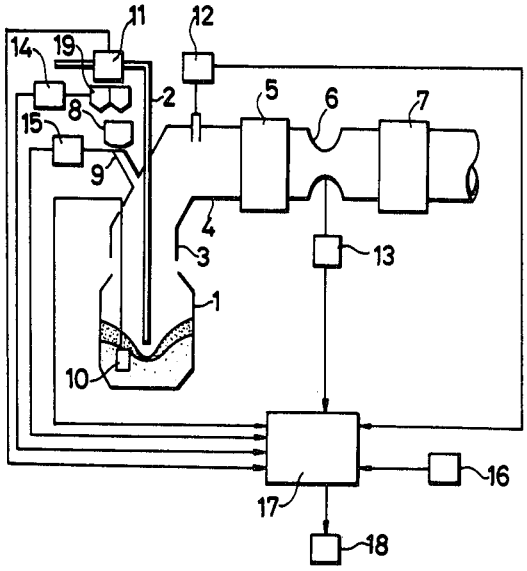
FIG. 1 is a block diagram schematically illustrating apparatus for embodying the method in accordance with the present invention.

First, the embodiment of the present invention will be described without reference to the drawings, and thereafter, the embodiment of the present invention will further be described in a concrete and detailed form.

As is known, there is a method of using a detecting probe attached to the tip of a sub-lance to measure the temperature of molten steel and the carbon content. For example, such method is disclosed in the U.S. Pat. No. 3,574,598 issued on Apr. 13, 1971 to David W. Kern and Phillip D. Stelts. This means may be utilized in embodying the process in accordance with the present invention. Other means may of course be employed.

First, the temperature of molten steel and the carbon content during the blowing are detected by the detecting probe at the suitable time in the midst of the blowing without stopping the feed of oxygen. Of the actually measured values thus obtained, let To (° C.) be the temperature of molten steel, and Co (%) the carbon content in the molten steel. Further, let $Fo_2$ ($Nm^3/Hr$) be the amount of oxygen to be fed after the detected time, and Fex ($Nm^3/Hr$) the flow rate of exhaust gases. The densities $X_{co}$, $X_{co_2}$, $X_{o_2}$, $X_{H2}$, $X_{N2}$ (%) of exhaust gas compositions CO, $CO_2$, $O_2$, $H_2$ and $N_2$, respectively, are detected by the respective known methods (for example, such as the infrared ray analyzing method, gas chromatographic method, and the like). In this case, $X_{N2}$ (%) can be obtained assuming that $N_2$ is one outside CO, $CO_2$, $O_2$ and $H_2$. It will be noted that in the analysis, the object of the present invention may be attained even if there is a slight signal time lag (for example, about 30 seconds at maximum).

When the flux or coolant is thrown or charged, its brand i (for example, iron ore, limestone, burnt lime, etc.) and the amount charged Wf (ton/Hr) are continuously detected. Since the abovementioned brands (materials) are separately stored by brand into a flux bunker by brand, the cut-down instruction signal may be utilized as a flux brand input signal or, information preset and instructed with respect to the cut-down may be utilized. It is to be noted that the term "continuously detects" herein means that momentary information (signal) are detected in accordance with the progress of the blowing using, for example, an analog or a digital signal every 0.1 to 15 seconds.

The total amount of oxygen $O_T$(Nm$^3$/Hr) introduced into the converter may be obtained from the abovementioned various information by the equation (1) described below. The amount of oxygen Oc (Nm$^3$/Hr) discharged as CO and $CO_2$ from the interior of the converter into the exhaust gases may be obtained by the equation (2). Or, in the case where $X_{N2}$ (%) is calculated by Xco to $X_{H2}$, it can be obtained by the equation (2'). Next, the amount of slag accumulated oxygen Os (Nm$^3$/Hr) may be calculated by the equation (3). In this case, when a plurality of brands of flux are particularly charged into the furnace at the same time, preferably results in terms of accuracy may be obtained by separately detecting and calculating the individual amount charged.

$$O_T(t) = F_{02}(t) + \sum_i (\alpha_i \cdot W_{fi}(t)) \quad (1)$$

$$O_c(t) = \frac{Fex(t)}{100} \cdot \left(\frac{1}{2} \cdot Xco(t) + Xco2(t) - \frac{21}{79} \cdot X_{N2}(t) + X_{02}(t) - \sum_i (\gamma_i \cdot W_{fi}(t))\right) \quad (2)$$

$$O_c(t) = \frac{Fex(t)}{79} \cdot (0.605 \cdot Xco(t) + Xco_2(t) + Xo2(t) + 0.21\, X_{N2}(t) - 0.21) - \sum_i (\gamma_i \cdot W_{fi}(t)) \quad (2')$$

$$O_{s(t)} = O_T(t) - O_c(t) - \beta \quad (3)$$

where t is the time passed from the detection time, which is assumed to be zero. i in the second term on the right side of equation (1), the second term on the right side of equation (2) and the second term on the right side of equation (2') is the respective brand when the plurality of brands of flux are charged at the same time. Hereinafter, Wfi refers to the charged amount Wf of the brand i.

The coefficient $\alpha$ is the oxygen generating coefficient (Nm$^3$/ton) of those flux that may be decomposed to generate oxygen, and naturally, those material, which will not generate oxygen, has zero in value. In case of the iron ore, the coefficient $\alpha$ can be considered 150 to 210 (Nm$^3$/ton).

The coefficient $\beta$ is the oxygen content per hour which escapes into the exhaust gases in the form of dust. According to the studies made by the present iventors, this coefficient $\beta$ can be considered 500 to 2000 (Nm$^3$/Hr).

Further, the coefficient $\gamma$ is the carbon dioxide generating coefficient (Nm$^3$/ton) of those flux that may be decomposed to generate carbon dioxide, and this is also the coefficient whose value is zero in case of those, which will not generate carbon dioxide. According to the present iventors, in case where the flux is limestone, the coefficent $\gamma$ can be considered 150 to 250 (Nm$^3$/ton).

Preferably, the $\alpha$ and $\gamma$ are predetermined from the compositions of the flux, and the $\beta$ from the actual results.

In this way, the carbon oxidation and the amount of slag forming or accumulated oxygen within the molten steel may be found, and therefore, if the total furnace reaction heat value resulting from the oxidation combustion is divided by the heat equivalent (the product of the specific heat and the mass, that is, the quantity of heat required to vary the mass in temperature of 1° C.) of the furnace charge, the momentary amount of temperature rise may be detected. That is, the amount of variation in instantaneous temperature rise dT(t) (° C./Hr) may be by equation (4) below.

$$dT(t) = \frac{Hc \cdot Oc(t) + Hs \cdot Os(t)}{Cs \cdot Ws} \quad (4)$$

where

Ws: amount of furnace charge (ton)

Cs: average specific heat of the furnace charge (Kcal/ton° C.)

Hc: combustion heat of carbon (Kcal/Nm$^3$O$_2$)

Hs: slag forming heat Kcal/Nm$^3$O$_2$)

According to the studies made by the present inventors, the combustion heat of carbon Hc is the coefficient of which value is 2500 to 3500 (Kcal/Nm$^3$O$_2$). Similarly, the slag forming heat Hs is the coefficient of which value is 5600 to 6600 (Kcal/Nm$^3$O$_2$). The average specific heat Cs of the furnace charge has its value of 200 to 270 (Kcal/T° C). The good result may be obtained by making operation using these values.

The momentary temperature of molten steel T(t) (° C.) may be given by the following equation (5) by integrating the amount of variation in instantaneous temperature rise dT using the actually measured temperature of molten steel and carbon content. In this case, however, it is necessary to consider the furnace cooling by the charge of the flux.

$$T(t) = To + \delta \int_o^t dT(t) \cdot dt - \int_o^t \sum_i (\epsilon_i \cdot W_{fi}(t))dt \quad (5)$$

where i represents the brand of flux when the plurality of brands of flux are used. The $\delta$ is the coefficient indicative of the thermal efficiency and can be obtained statistically from the past actual results of blowing in the converter, and the value thereof is 0.6 to 1.0 according to the studies made by the present inventors. These should be obtained from the actual results of the respective converter. The $\epsilon$ is the cooling coefficient (° C./ton) of flux, and is, in a certain embodiment, 30 to 40 (° C./ton) for iron ore, 10 to 20 (° C./ton) and 5 to 15 (° C./ton) for burnt lime. Preferably, these are obtained beforehand from the composition (kind) of the flux, the rate of mixture, and the actual results of the converter.

Next, in order to obtain the momentary carbon content in the molten steel C(t) (%), the decarburization velocity Vc(ton/Hr) may be obtained by the following equation (6) and the following equation (7) are integrated to calculate the amount of decarburization $\Delta C(t)$, thereby predicting C(t) (%) in the following equation (8) with the aforesaid Co being the starting point.

$$Vc(t) = \{Fex(t) \cdot (Xco(t) + Xco_2(t)) \cdot 10^{-2} - \sum_i (\gamma_i \cdot W_{fi}(t))\} \cdot \frac{12}{22.4} \cdot 10^{-3} \quad (6)$$

$$\Delta C(t) = \int_o^t Vc(t) \cdot dt \quad (7)$$

$$C(t) = S_1 \cdot Co + \frac{S_2}{W_s} \cdot \Delta C(t) 10^{-2} + S_3 \quad (8)$$

where, in one embodiment, $S_1$=0.5 to 1.5, preferably 0.6

$S_2$=−0.5 to −1.5, preferably −0.8

$S_3$=−30 to 30, preferably 9.0

It has been found that these coefficients $S_1$, $S_2$, $S_3$ vary with the special quality of the detecting probe, the equipment conditions of the converter or the operating conditions, and these coefficients should be obtained statistically from the past actual results of the converter in order to keep the accuracy thereof.

From the foregoing description, continuous variation of the molten steel temperature and the carbon content after the molten steel temperature and the carbon content in the molten steel have been detected at the suitable time, and locus therefor is found.

Next, the relationship between the molten steel temperature and the carbon content close to the aforesaid locus so far obtained at the thereafter suitable time is substituted by the functional formula described later to thereby determine the coefficient of the functional formula, and the predicted curve of the thereafter molten steel temperature and the carbon content may be calculated by the functional formula determined.

In determining the abovementioned functional formula, a specific functional formula may be predetermined, or the above-mentioned relationship between the molten steel temperature and the carbon content may be substituted by a plurality of functional formulae described later to determine coefficients of said plurality of functional formulae, respectively, after which of these coefficients, the optimum one can be selected.

The abovementioned functional formula will now be discussed. Where blowing oxygen is consumed only for decarburization within the furnace, the total furnace heat value is only the oxidation combustion heat of the carbon content in the molten steel, and the relationship between te carbon content in the molten steel and the molten steel temperature may be represented by the primary linear form. Further, where blowing oxygen is consumed only for slag formation within the furnace, the carbon content remains unchanged and only the temperature of molten steel increases. From such a purely theoretical consideraton, the present inventors worked out the following equation (9).

$$T(t) = \frac{S_4}{C(t) + S_5} + S_6 \cdot C(t) + S_7 \tag{9}$$

The denominator $C(t)+S_5$ of said equation may be replaced by the square root thereof. Then, the relationship between the molten steel temperature and the carbon content close to the aforementioned locus is substituted by the equation (9) to determine the coefficients $S_4$, $S_5$, $S_6$ and $S_7$, whereby the thereafter predicted curve of the locus may properly be obtained.

It will be noted that depending upon various conditions of equipment and operation such as furnace configuration, blowing lance nozzle configuration and the like, other functional formula other than equation (9) may analogously be employed. For example, equations such as the following equations (10) or (11), which can sufficiently indicate the relationship between the molten steel temperature and the carbon content in the blowing, may also be used.

$$T(t) = S_8 \cdot \exp\left(-\frac{S_9}{C(t)^2}\right) + S_{10} \cdot C(t) + S_{11} \tag{10}$$

$$T(t) = \sum_j S_{12j} C^j_{(t)} \tag{11}$$

According to the study made by the present inventors, j in equation (11) is preferably 2 to 4 in value.

From the predicted orbit or curve thus obtained of the molten steel temperature and the carbon content, predicting of the molten steel temperature and the carbon content resulting from the thereafter blowing is carried out, and change in amount of oxygen fed, change in height of a blowing lance or control of charging the flux may positively be executed at need in accordance with the difference between the results of said prediction and the desired molten steel temperature and the desired carbon content.

In the following, prediction and control of the molten steel temperature and the carbon content in accordance with the present invention will be described in detail with reference to the drawings.

Referring now to FIG. 1, there is shown a converter 1, and oxygen is introduced into molten steel from a blowing oxygen lance 2. The exhaust gases generated in the converter 1 pass through a collecting hood 3 and an exhaust gas duct 4 and are guided into a holder (not shown) or stack (not shown) via a dust collector 5, a throat 6, and an induced draft fan 7. The flux is thrown or charged into the converter 1 by a charging feeder 9 from a flux bunker 19 by brand through a hopper 8. The structure just mentioned is the same as that of prior art.

In order to obtain various information required to carry out the method of the present invention, an oxygen flow meter 11 is connected to the oxygen lance 2, an exhaust gas analysis meter 12 is connected to the exhaust gas duct 4, an exhaust gas flow meter 13 is connected to the throat portion 6, an flux brand input device 14 is connected to the bunker 19, and an flux charging amount transmitter 15 is connected to the charging feeder 9. An operating device or arithmetic unit 17 obtains various information from the aforementioned elements and information from a furnace charge input device 16 for necessary operation to indicate the operation results in an indicating tube 18.

The operation of the present apparatus will now be described referring to FIG. 1 along with FIG. 2. The temperature of molten steel $T_o$ and the carbon content $C_o$ are simultaneously detected by a probe 10 for simultaneously measuring the molten steel temperature and the carbon content at the suitable time (t=O) during the blowing process without stopping the feed of oxygen, after which the amount of oxygen fed $F_{o2}(t)$, exhaust gas composition $X_{co}(t)$,$X_{co2}(t)$, $H_{o2}(t)$, $X_{H2}(t)$ and $X_{N2}(t)$, and exhaust gas flow Fex (t) are continuously measured by the oxygen flow meter 11, exhaust gas analysis meter 12, and exhaust gas flow meter 13, respectively, where t is the time passed from said detected time. Where the flux is charged, the brand i (such as iron ore, limestone, and burnt lime) and the amount charged Wf(t) may be detected and measured by the flux brand input device 14 and the flux or coolant charging transmitter 15, respectively. In addition to the foregoing, the composition and the amount of the furnace charged prior to said detected time as the second information $W_S$ of the charge are inputted from the furnace charge input device 16 into the operating device 17, by which the amount of oxygen $O_c(t)$ used for decarburization and the amount of slag accumulated oxygen $O_s(t)$ are continuously calculated on the basis of the abovementioned preset operating equations and operating coefficients to calculate the total furnace reaction heat value and the amount of decarburization $\Delta C(t)$, and using the molten steel temperature $T_o$ and the carbon content $C_o$ previously detected by the probe 10 as the starting point, the thereafter variation in molten steel temperature and variation in carbon content are continuously indicated in the indicating tube 18. If necessary, the predicted orbit or curve of the thereafter molten steel temperature and carbon content in the molten steel is calculated from the close trend of estimated flows relative to the molten steel temperature and the carbon content so far attained and is indicated in the indicating tube 18 at the same time.

Thus, the operator can simultaneously grasp the continuous variation of the molten steel temperature and the carbon content, that is, the highly precise indices by viewing the indicating tube 18, so that the thereafter proper operation becomes possible.

The present inventors have actually assured by using a sublance that the molten steel temperature and the carbon content may accurately be predicted and controlled at the suitable time after the actual measurement in accordance with the present invention. Thereby, the operator can simultaneously grasp the temperature of molten steel and transition of the carbon content and further can grasp the thereafter predicted curve at need, so that the optimum control of the thereafter operation may be carried out. As one of actual examples, there is illustrated a case where the molten steel temperature and the carbon content at the terminal of blowing have been predicted and controlled in a 170-ton converter in order to explain the accuracy of prediction and control in the present invention.

Figure 3:
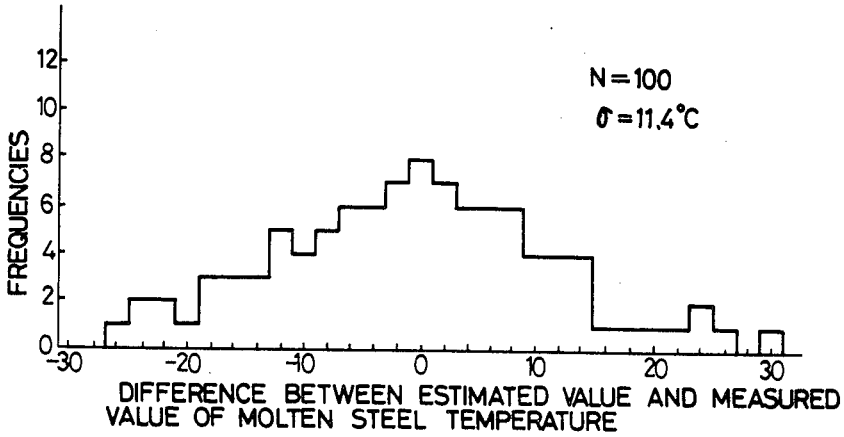
FIG.3 PRIOR ART
FIGS. 3 and 4 are graphic representations showing the prediction accuracy of the molten steel temperatures and carbon contents, the conventional method being applied to a 170-ton converter.
Figure 4:
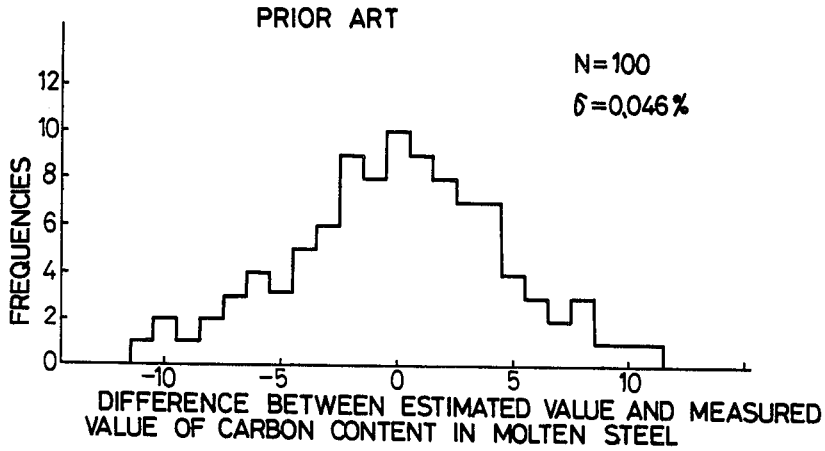

FIGS. 3 and 4 show 100 examples with respect to a difference between the estimated value at the blow end and the actually measured value in accordance with the conventional process, the axis of ordinate illustrating the frequencies while the axis of abscissa illustrating the abovementioned difference. FIG. 3 shows the prediction accuracy of the moten steel temperature, and FIG. 4 shows the prediction accuracy of the carbon content in the molten steel. As may be best shown in the figures, as for the molten steel temperature, the standard deviation $\delta$ is 11.4 (° C.), whereas, as for the carbon content in the molten steel, the standard deviation $\delta$ is 0.046 (%), which tells that reliability is poor.

Figure 5:
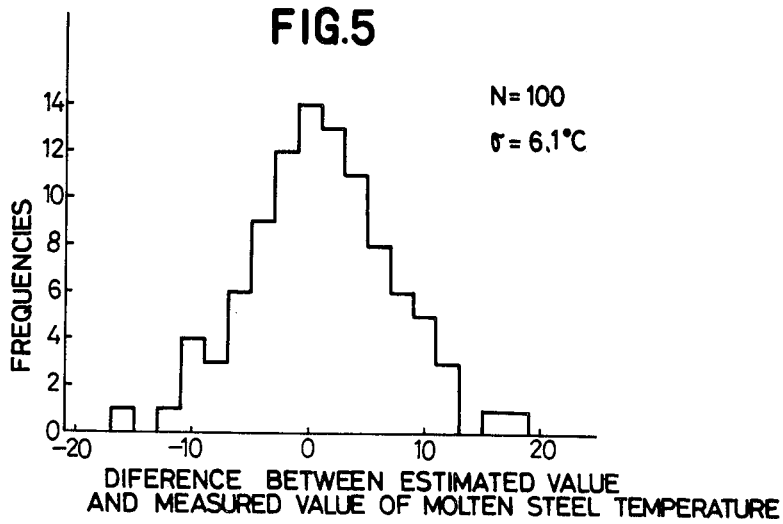
FIGS. 5 and 6 are graphic representations showing the prediction accuracy of the molten steel temperatures and the carbon contents, the method of the present invention being applied to a 170-ton converter.
Figure 6:
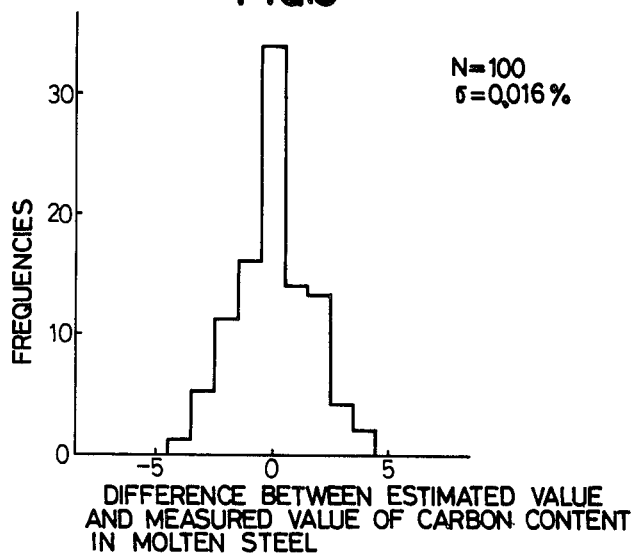

FIGS. 5 and 6 show 100 examples in accordance with the present process, the axis of abscissa illustrating the difference between the estimated value at the blow end and the actually measured value while the axis of ordinate illustrating the frequencies. FIG. 5 shows the prediction accuracy of the molten steel temperature, and FIG. 6 shows the prediction accuracy of the carbon content in the molten steel. As may be best shown in the figure, as for the molten steel temperature, the standard deviation $\delta$ is 6.1 (° C.), whereas, as for the carbon content in the molten steel, the standard deviation $\delta$ is 0.016 (%), which tells that the accuracy is greatly increased as compared to the conventional process.

FIGS. 7 to 10 show variation in molten steel temperature and carbon content during the blowing, the axis of abscissa illustrating the carbon content in the molten steel while the axis of ordinate illustrating the molten steel temperature, by way of one example of a locus curve. FIG. 11 shows a modified form.

Figure 7:
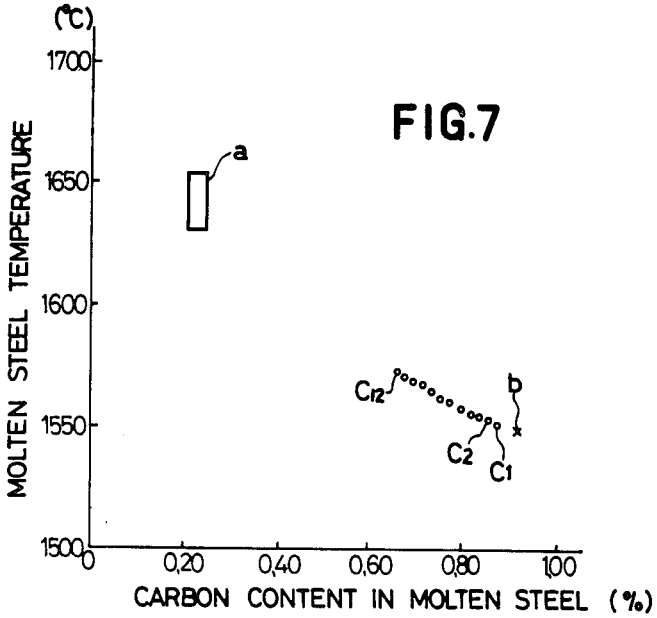
FIGS. 7 to 10 are explanatory views of continuous prediction of the molten steel temperatures and the carbon contents in accordance with the present invention and the predicted orbit or curved based thereon.

First, referring to FIG. 7, a represents the range of the desired molten steel temperature and carbon content, b the detected values (Co, $T_O$) by means of the sublance at the suitable time during the blowing, and $C_1$, $C_2$ . . . $C_{12}$ twelve estimated values obtained by the method of the present invention. While $C_1$ to $C_{12}$ have been obtained every two seconds in the illustrated embodiment, it will be understood that they may also be suitable intervals of from 0.1 to 10 seconds or consecutive analog values.

Figure 8:
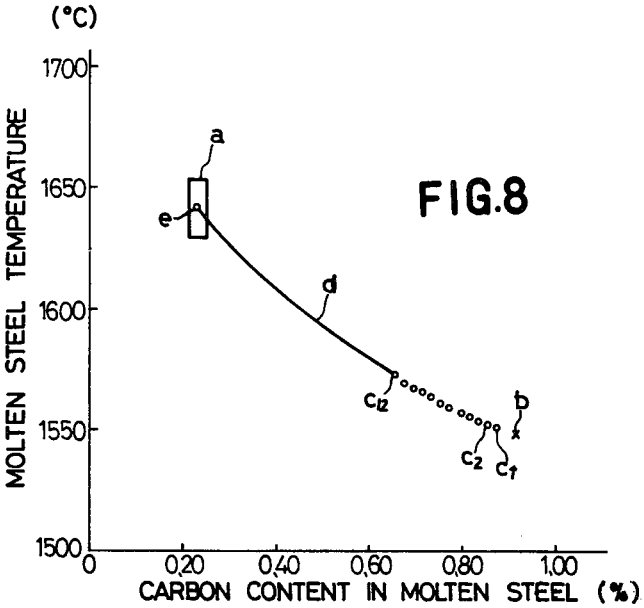

FIG. 8 shows the step next to that of FIG. 7, wherein the trend of ten points (that is, from $C_3$ to $C_{12}$) close to the estimated value $C_{12}$ is detected at the final estimated value $C_{12}$ obtained in FIG. 7, on the basis of which the predicted orbit d indicative of variation in molten steel temperatute and carbon content after the point $C_{12}$ is calculated using the equation (9).

In the illustrated embodiment, since the predicted orbit or curve d reaches point e, the d would hit the desired range or target a. However, the predicted orbit d is sometimes deviated from the a depending upon the trend of from $C_3$ to $C_{12}$. Such as example will be described hereinafter with reference to FIG. 11.

Figure 9:
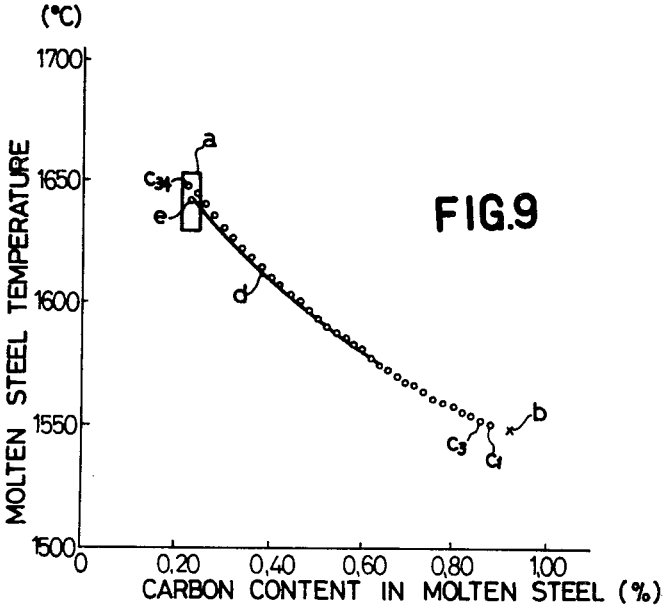

FIG. 9 shows that consecutive twenty-two predicted values of the molten steel temperature and the carbon content after the time of the final estimated value $C_{12}$ in FIG. 8 (that is, the time indicative of the predicted curve) finally reaches $C_{34}$ and hits the desired range a.

Figure 10:
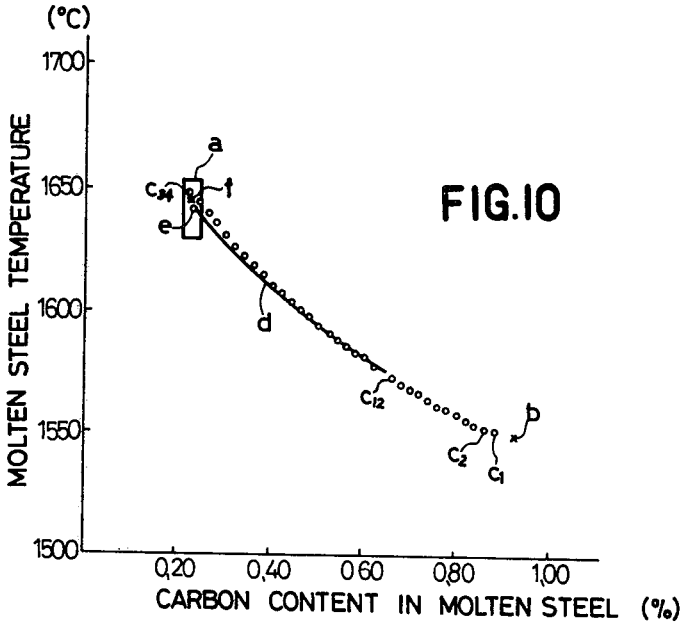
Figure 11:
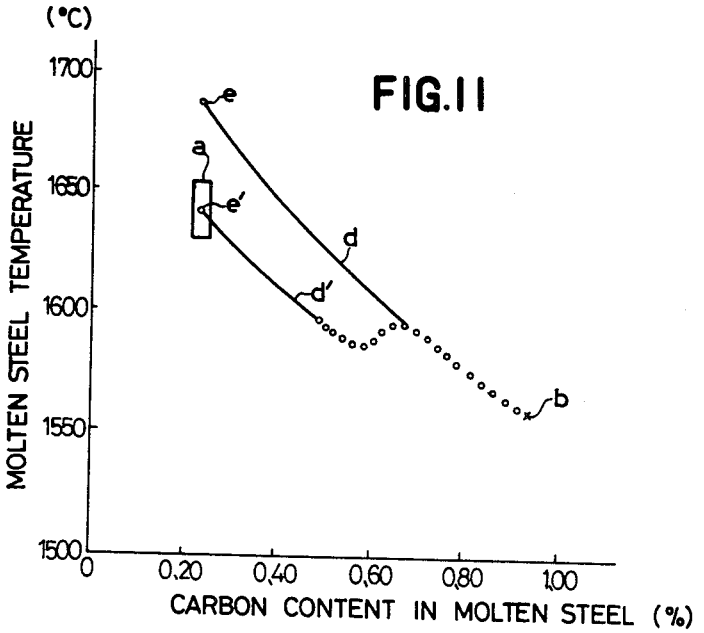
FIG. 11 is a view showing a modified form thereof.

FIG. 10 shows that the blow end is at the point of the predicted value $C_{34}$, and the value f detected by actually using the sub-lance also hit the desired range a.

Thus, in accordance with the controlling method of the present invention, it is possible to know a highly precise predicted orbit or curve prior to reaching the blow end, and therefore, corrective operation may suitably be carried out at need to be controlled easily toward the desired range, and finally hitting thereto.

While the predicted orbit hits the desired range of the molten steel temperature and the carbon content at the end of blowing, it will be appreciated that other cases may of course be considered, and the locus of variation in molten steel temperature and carbon content is sometimes already deviated from the desired locus. Where the predicted orbit is deviated from the desired range, necessary control may be carried out to correct the thereafter locus in consideration of deviation of the desired range from the predicted orbit, as previously described.

FIG. 11 shows that the initial predicted orbit or curve d passes point e deviated from the desired range a as described above. In this case, the operating conditions or the like may be changed, at the time when the predicted orbit d is found to be deviated from the desired range a, so that a new predicted orbit or curve d' may pass point e' within the desired range a.

One example of the results obtained by controlling the molten steel temperature and the carbon content at the end of blowing in accordance with the present invention is given in the following Table I showing the hit results of the molten steel temperature and the carbon content at terminal to the desired range as an actual result of about 1,500 times.

Table 1

| | Conventional method | Present method |
|---|---|---|
| Rate of hit, molten steel temperature at the flow end | 73.0% | 98.3% |
| Rate of hit, carbon content in molten steel at the flow end | 72.7% | 92.3% |
| Simultaneous rate of hit, molten steel temperature and carbon content at the flow end. | 55.3% | 90.5% |

As described above, the molten steel temperature and the carbon content may simultaneously be controlled with accuracy, and particularly in the case where the present invention is applied to control the molten steel temperature and carbon content at the end of blowing, the original unit of the furnace material of the converter and the efficiency of steel making may be increased due to enhancement of quality and reduction in re-blowing.

What is claimed is:

1. A method of controlling the temperature and the carbon content of molten steel in an oxygen converter so that the temperature and the carbon content of the molten steel at blow end will be within a desired range of values, comprising the steps of:

measuring the composition of and the amount of the charge within the converter;

blowing the oxygen into the molten steel and continuously measuring the amount of oxygen supplied;

directly measuring the temperature and the carbon content of the molten steel during the oxygen blowing without interruption of the blowing;

continuously measuring the composition and flow rate of the exhaust gases;

calculating the continuous change in the amount of decarbonization, which amount is calculated by performing integration of the decarbonization velocity Vc(t), said decarbonization velocity being defined as:

$$Vc(t) = \{Fex(t) \cdot (Xco(t) + Xco_2(t)) \cdot 10^{-2} - \sum_i (\gamma_i \cdot Wfi(t))\} \cdot \frac{12}{22.4} \cdot 10^{-3}$$

wherein:

Fex=the flow rate of the exhaust gases in $Nm^3/hr$.

Xco=the density of the exhaust gas co in %

$Xco_2$=the density of the exhaust gas $co_2$ in %

$\gamma$=the $co_2$ generating coefficient of the flux in $Nm^3/ton$

Wf=the amount charged in ton/hr i=the type of flux t=time and $(12/22.4)\cdot 10^{-3}$ represents a conversion constant for units being used;

calculating the continuous change in the amount of total converter reaction heat value T(t) from the relationship:

$$T(t)=To+\delta \quad dT(t)\cdot dt- \quad (ei\cdot Wfi(t))dt$$

wherein:

dT=the amount of variation in instantaneous tempterature rise in ° C./hr

To=the initial temperature in °C.

$\epsilon$=the cooling coefficient of the flux in ° C./ton $\delta$=the coefficient of thermal efficiency;

obtaining a future locus variation of the temperature and the carbon content by plotting the values measured and calculated and obtaining the formula of a curve which interconnects the values thereby establishing a relationship which correlates the temperature and the carbon content of the molten steel;

predicting the final range of the temperature and the carbon content of the molten steel at the blow end by extrapolating said future locus variation; and controlling at least one operating parameter in response to a difference between the desired range and the predicted range.

2. A method as claimed in claim 1 further comprising the step of displaying the continuous changes in the temperature and the carbon content of the molten steel so that the operator may simultaneously grasp the same for proper operation thereafter.

3. A method as claimed in claim 1 wherein said future locus variation is determined by using estimated values of the temperature and the carbon content of the molten steel, said estimated values being close to an estimated value at the starting time of said prediction, which may be started at a desired time after said direct measurement is carried out.

4. A method as desired in claim 3, further comprising the steps of determining a regression equation by using said estimated values of the temperature and the carbon content of the molten steel, and extrapolating said regression equation in order to obtain said future locus variation.

5. A method of controlling the temperature and the carbon content of molten steel during an operating time period of an oxygen converter so that the temperature and the carbon content at the blow end will be within predetermined desired values comprising the steps of:

measuring the composition and the amount of the charge within the converter prior to the operating time period;

blowing oxygen to the molten steel during said operating time period by utilizing an oxygen blowing lance which is maintained immersed in the molten steel;

measuring the amount of oxygen supplied into the molten steel through the blowing lance, said amount of oxygen being utilized to determine the amount of slag accumulated oxygen;

immersing a detecting probe into the molten steel to directly measure the temperature and carbon content of the molten steel during the later part of said operating period while the oxygen blowing is being carried out;

detecting the type and amount of the fluxes which are supplied after said direct measurement, as well as the composition and flow rate of the exhaust gases and combining these detected values to calculate the amount of oxygen used for decarbonization and the continuous changes in the amount of decarbonization using the relationships:

$$O_T(t) = Fo_2(t) + \sum_i (\alpha_i \cdot Wfi(t))$$

$$Oc(t) = \frac{Fex(t)}{100} \cdot (\frac{1}{2} \cdot Xco(t) + Xco_2(t) - \frac{21}{79} \cdot X_{N2}(t) + Xo_2(t)) - \sum_i \gamma_i \cdot Wfi(t))$$

$$Vc(t) = \{Fex(t) \cdot (Xco(t) + Xco_2(t)) \cdot 10^{-2} - \sum_i (\gamma_i \cdot Wfi(t)\} \cdot \frac{12}{22.4} \cdot 10^{-3}$$

and $$\Delta C(t) = \int_o^t Vc(t)dt$$

wherein:

$Fo_2$=the amount of oxygen to be fed in $Nm^3/hr$

Fex=the flow rate of the exhaust gases in $Nm^3/hr$

Xco, $Xco_2$, $X_{n2}$, $Xo_2$=the densities of the exhaust gas composition in %

$\gamma$=the $co_2$ generating coefficient of the flux in $Nm^3/ton$ $\alpha$=the oxygen generating coefficient of the flux in $Nm^3/ton$ Wf=the amount charged in ton/hr i=the type of flux $O_T$=the total amount of oxygen in $Nm^3/hr$ OC=the amount of oxygen used for decarbonization in $Nm^3/hr$ Vc=the decarburization velocity and C=the carbon content in %;

combining the amount of oxygen used for decarbonization and the amount of slag accummulated oxygen to calculate the continuous change in the amount of total converter reaction heat value using the relationships $$Os(t) = O_T(t) - Oc(t) - \beta$$

$$dT(t) = \frac{Hc \cdot Oc(t) + Hs \cdot Os(t)}{Cs \cdot Ws}$$

and $$T(t) = To + \delta \int_o^t dT(t) \cdot dt - \int_o^t \sum_i (\epsilon_i \cdot Wfi(t))dt$$

wherein

Os=the amount of slag accumulated oxygen in $Nm^3/hr$ $\beta$=the oxygen content per hour which escapes in the form of dust in $Nm^3/hr$ dT=the amount of variation in the instantaneous temperature rise in ° C./hr Ws=the amount of furnace charge in tons Cs=the average specified heat of the furnace charge in Kcal/ton° C.

Hc=the combustion heat of carbon in $Kcal/Nm^3O_2$

Hs=the slag forming heat in $Kcal/Nm^3/O_2$

To=the initial temperature in °C.

$\epsilon$=the cooling coefficient of the flux in °C./ton $\delta$=the coefficient thermal efficiency;

determining a locus variation of the temperature and the carbon content of the molten steel at a specified time following said direct measurement by plotting the values measured and calculated for the temperature and carbon content of the molten steel and obtaining the formula of a curve which interconnects these values to establish a relationship which corrleates the temperature and the carbon content of the molten steel;

predicting the final values of the temperature and carbon content of the molten steel at the blow end by extrapolating said future locus variation; and controlling at least one parameter in response to the difference between the predicted values and the desired values said parameter selected from the group consisting of the amount of oxygen fed, the type and amounts of fluxes supplied, and the lance height, whereby the desired values can be achieved and precise quality control of the molten steel and reduction in reblowing are achieved.

6. A method as claimed in claim 5 further comprising the step of displaying the continuous changes in the temperature and the carbon content of the molten steel so that the operator may simultaneously grasp the same for proper operation thereafter.

7. A method as claimed in claim 5, wherein said future locus variation is determined by using estimated values of the temperature and the carbon content of the molten steel, said estimated values being close to an estimated value at the starting time of said prediction which may be started at a desired time after said direct measurement is carried out.

8. A method as claimed in claim 7, further comprising the steps of determining a regression equation by using said estimated values of the temperature and the carbon content of the molten steel, and extrapolating said regression equation in order to obtain said future locus variation.

* * * * *

UNITED STATES PATENT AND TRADEMARK OFFICE

CERTIFICATE OF CORRECTION

PATENT NO. : 4,150,973

DATED : April 24, 1979

INVENTOR(S) : Shin-Ichi Sanuki, et al.

It is certified that error appears in the above–identified patent and that said Letters Patent are hereby corrected as shown below:

In Claim 1, line 46, change:

"$T(t)=To+\int dT(t)\cdot dt- (ei\cdot Wfi(t))dt$" to

-- $T(t)=To+\int_0^{\tau} dT(t).dt - \int_0^{\tau}\sum_{1}(\pounds i.Wfi(t))dt$ --.

Signed and Sealed this

*Eighteenth* Day of *September 1979*

[SEAL]

*Attest:*

*Attesting Officer*

LUTRELLE F. PARKER

*Acting Commissioner of Patents and Trademarks*